US006612318B1

(12) United States Patent
Sylvain et al.

(10) Patent No.: US 6,612,318 B1
(45) Date of Patent: Sep. 2, 2003

(54) INSTALLATION FOR PICKLING A METAL BAND

(75) Inventors: Daniel Sylvain, Verneuil sur Seine (FR); Philippe Barbieri, Lyons (FR)

(73) Assignee: Vai Clecim, Courbevoie (FR)

( * ) Notice: Subject to any disclaimer, the term of this patent is extended or adjusted under 35 U.S.C. 154(b) by 0 days.

(21) Appl. No.: 09/420,801

(22) Filed: Oct. 19, 1999

(30) Foreign Application Priority Data

Oct. 22, 1998 (FR) ..... 98 13277

(51) Int. Cl.[7] ..... B08B 3/02

(52) U.S. Cl. ..... 134/64 R; 134/122 R; 134/199

(58) Field of Search ..... 134/64 R, 64 P, 134/122 R, 122 P, 199; 266/111; 68/181 R

(56) References Cited

U.S. PATENT DOCUMENTS

| | | | | |
|---|---|---|---|---|
| 2,234,815 | A | * | 3/1941 | Wood |
| 2,418,386 | A | | 4/1947 | Wood |
| 3,445,284 | A | | 5/1969 | Robinson, Jr. et al. |
| 5,116,447 | A | * | 5/1992 | Kimura et al. |
| 5,248,372 | A | * | 9/1993 | McNamee |
| 5,361,788 | A | * | 11/1994 | Cole et al. |
| 5,634,481 | A | * | 6/1997 | Legoupil |
| 5,853,495 | A | * | 12/1998 | Gravert et al. |

FOREIGN PATENT DOCUMENTS

| | | | |
|---|---|---|---|
| DE | 4108516 | * | 9/1991 |
| DE | 40 31 234 | | 4/1992 |
| DE | 42 40 572 | | 6/1994 |
| FR | 2 683 833 | | 5/1993 |
| JP | 63-227792 | | 9/1988 |
| JP | 63-307287 | | 12/1988 |
| JP | 4-313417 | * | 11/1992 |

* cited by examiner

*Primary Examiner*—Frankie L. Stinson
(74) *Attorney, Agent, or Firm*—Arent Fox Kintner Plotkin & Kahn

(57) ABSTRACT

This invention relates to an installation for pickling a metal band by immersion through at least one bath (3) filled with a pickling liquid contained in a tank (1).

According to the invention, each tank (1) is provided with at least one row of injection nozzles (5) distributed longitudinally and supplied with pressurized pickling liquid in order to make at least one series of liquid jets reaching inside the bath (3), whereas the said nozzles (5) are placed at different levels matching the shape of the curve followed by the band (2) in the tank (1) so that the liquid jet injected into the bath (3) by each nozzle (5) is directed straightforwardly to the portion (23) of the band (2) passing in front of the nozzle in question.

17 Claims, 2 Drawing Sheets

INSTALLATION FOR PICKLING A METAL BAND

FIELD OF THE INVENTION

This invention relates to an installation for pickling a metal band by passing the latter inside at least one oblong tank containing a pickling liquid.

BACKGROUND OF THE INVENTION

We know that during the rolling of metal bands, it is necessary to subject the band to superficial pickling intended, primarily, for the removal of oxyde on the surface of the band. To this end, the band is made to pass continuously, along a longitudinal direction, through an installation comprising, generally, several oblong tanks, each filled with a bath of liquid acid, intended for dissolving the oxyde.

Such installations have been in service for a long time and subjected to various improvements. Usually, the band passes through several successive tanks filled with acid, over guiding and back-up means arranged at the inlet and the outlet of each tank, above the level of acid. The band makes thus a series of curved sections immersed successively into the different tanks and each of the shape of a chain resting, at its extremities, on the back-up means, arranged respectively at the inlet and the outlet of the tank. Such an installation is disclosed, for instance in U.S. Pat. No. 3,445,284.

The acid concentration of the pickling liquid is reduced together with the dissolution of the oxyde and the acid has therefore to be renewed.

To this end, according to a well known arrangement, disclosed for instance in U.S. Pat. No. 3,445,284, acid is made to flow from one tank to another, in the reverse direction of the passage of the band that passes successively through baths whose acid concentration increases gradually. The first tank, in the flow direction, contains therefore the liquid the most filled with iron oxide that overflows toward an external regeneration circuit enabling to send a purified and more concentrated liquid back to the last tank in the line.

Moreover, the band reaches the pickling installation in a relatively cold condition and heats up in contact with the liquid that, conversely, cools down.

In order to maintain the temperature of the liquid at the requested level, each tank can be associated with a heating circuit comprising a pump drawing a portion of the liquid contained in the tank in order to send it back into the said tank, after being reheated in an heat exchanger.

Besides, the duration of the treatment depends on the flow speed of the band and on the depth of immersion in each tank, which depends on the strain applied to the band. In known installations of the type disclosed in U.S. Pat. No. 3,445,284, relatively deep tanks are used in order to limit the strain applied to the band. The consequence is the production of a large consumption of acid and an emission of very corrosive vapours which, even if they are caught and exhausted, may damage the various devices placed in the vicinity of the pickling installation.

To avoid these shortcomings and to reduce the quantity of acid necessary, it has been suggested to pass the band horizontally inside at least one oblong chamber of small height, closed by a lid and provided with lateral injectors. Thus, the band is not immersed in successive tanks any longer, but is subjected directly to acid jets. This chamber is placed in a tank that collects the acid that might escape through the openings of the band located at the inlet and the outlet of the chamber.

In such an arrangement, disclosed for instance in U.S. Pat. No. 2,418,386, the quantity of acid involved is reduced since the band need not be immersed into a bath, whereas the acid is injected directly over the band and renewed permanently. Besides, the emissions of acid are smaller than in the conventional tanks.

However, in such an installation, the band must be maintained rectilinear inside the treatment chamber and it is therefore supported by a series of aligned studs, provided on the floor of the chamber and delineating a horizontal plane for the band to run.

When running, the band slides over back-up studs. The pressure of application can be reduced by stretching the band, but the applicable tensile strain is necessarily limited, in particular in the case of very thin and relatively fragile bands. Frictions that may damage the surface of the band cannot then be avoided totally.

SUMMARY OF THE INVENTION

This invention relates to a new type of installation enabling to overcome all these shortcomings, while keeping the advantages of the pickling installations used until now.

Generally speaking, the pickling installation according to the invention is of the type comprising at least one oblong tank containing a liquid bath through which the band runs while making, inside the tank an upward concave curve with two extremities each located at an upper level determined by means for backing up the band, placed at both ends of the tank and a central portion lying at a lower level, immersed in the bath. This curve, in the form of a chain, has a deflection corresponding to the level difference between both ends and the central portion and whose value depends on the tensile strain applied to the band.

According to the invention, each tank is provided with at least one row of injection nozzles distributed along at least one of the longitudinal walls of the tank and linked to a pressurised supply circuit filled with pickling liquid in order to form at least one series of liquid jets penetrating inside the bath and the said nozzles are offset longitudinally and placed at different levels which, for each nozzle, depend on the longitudinal distance of the said nozzle with respect to an extremity of the tank and correspond substantially to the level of a portion of the band located at the same distance from the said extremity, so that the liquid jet injected into the bath by each nozzle is directed to the portion of the band passing in front of the nozzle in question.

Generally speaking, the arrangement of the nozzles is determined in relation to the shape taken by the band in the normal running conditions and, while the band is running, the tensile strain applied to the band is adjusted so that the curve formed by the band is maintained in permanence at each nozzle.

Preferably, the injection nozzles are distributed into two rows arranged respectively along both longitudinal walls of the tank and offset longitudinally with respect to one another so that the jet of a nozzle from a longitudinal wall passes between the jets emitted by two nozzles of the other wall.

Besides, the nozzles are advantageously oriented so that the jet of injected liquid is centred on a direction forming a non-right angle with the longitudinal running direction of the band, preferably against the running direction of the said band.

According to another advantageous feature, the bottom of the tank has an upward concave shape that is substantially parallel to the shape of the curve followed by the band under normal running conditions of the said band, whereas the tensile strain on the band is adjusted so that the curve formed by the band remains permanently substantially parallel to the bottom and spaced from the said bottom by a safety distance that is sufficient to avoid any contact between the band and the bottom while the band is running.

Besides, the pickling liquid supply circuit comprises at least one pump leading to a manifold to which are connected feeding ducts for each injection nozzle. Preferably, this pump is of the centrifugal type and is driven into rotation by a motor whose speed is adjusted in order to adapt the flowrate and the pressure of the liquid injected to the pickling conditions to be ensured for the band.

According to another particularly advantageous feature, each tank is provided with at least one exhaust orifice provided in at least one of the longitudinal walls of the tank for maintaining, thanks to an overflow, the surface of the pickling bath at substantially constant level. It is, moreover, particularly advantageous to use at least two exhaust orifices placed at two different levels with respect to the upper level of the back-up means and each associated with a removable closing means, for maintaining selectively the level of the surface of the bath at two levels at least, by opening one of the orifices and closing the other, whereas the level of the orifice kept open is determined in relation to the running speed of the band in order to suit the immersion length in each tank to the said running speed.

Preferably, each exhaust orifice leads to an exhaust caisson linked to a storage tank to which is connected a pressurised supply circuit of the injection nozzles by recycling the pickling liquid overflowing from the tank, whereas the said circuit comprises a means for reheating the recycled liquid.

Advantageously, the installation comprises a plurality of tanks, each associated with a storage tank and through which the band circulates in succession, all these tanks are linked to one another by ducts in order to enable the liquid to circulate from one tank to another in reverse direction of the running direction of the band, while increasing, from one tank to the next, the concentration in pickling liquid acid, whereas the tank associated with the uppermost tank in the running direction of the band is connected to purification and regeneration means of the liquid and whereas the regenerated liquid is sent back to the lowermost tank in the running direction of the band.

BRIEF DESCRIPTION OF THE DRAWINGS

The invention also relates to other advantageous features, mentioned in the claims, and which will appear in the following description of a particular embodiment, described for exemplification purposes and represented on the appended drawings.

DETAILED DESCRIPTION OF THE PREFERRED EMBODIMENT

Generally, the pickling installation is of the conventional type, with an immersed band, disclosed for example in U.S. Pat. No. 3,445,284. Such an installation comprises therefore a plurality of tanks, for example three or four, arranged one after the other along a longitudinal running direction of the band and each containing a pickling liquid bath. At both extremities of each tank are placed means for backing up the band enabling the said band to run from one tank to the next while passing over their adjacent extremities in order to form inside each tank, a curve in the form of a chain immersed into the pickling bath.

Figure 1:
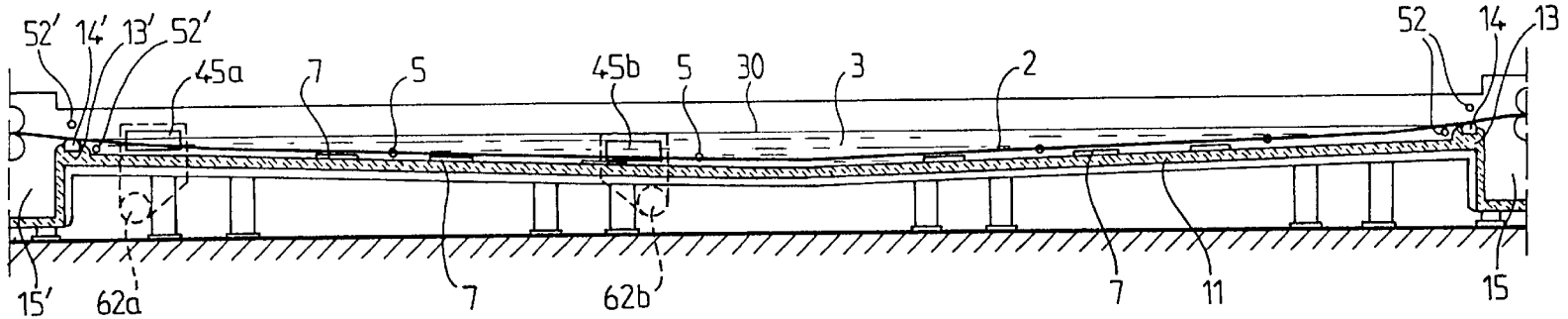
FIG. 1 is a longitudinal sectional view of a pickling tank according to the invention.
Figure 2:
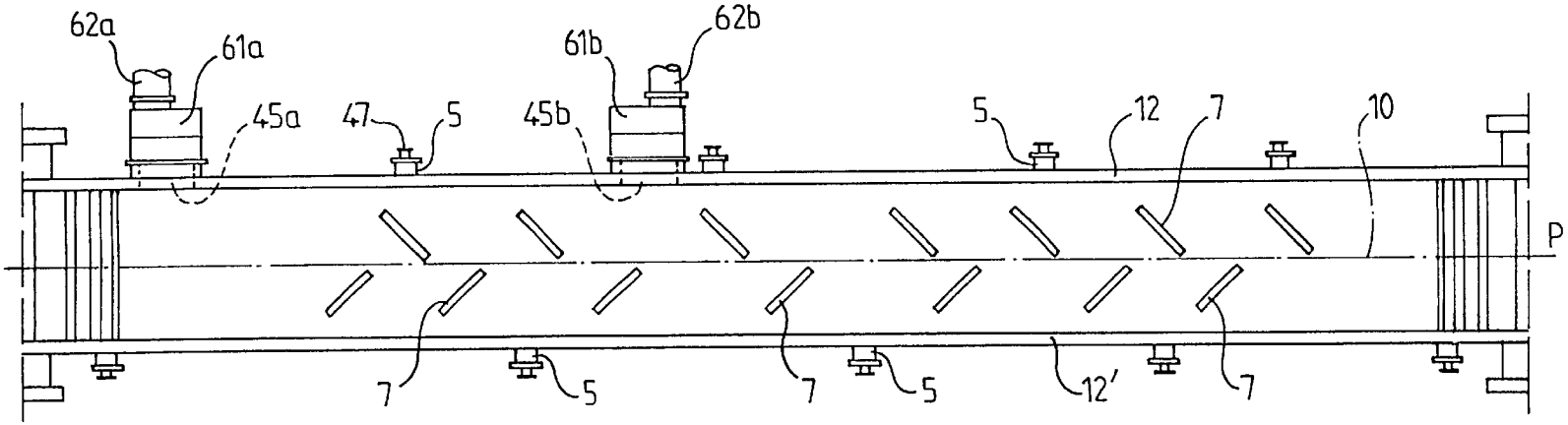
FIG. 2 is a top view of the pickling tank.

FIGS. 1 and 2 show, for example, a pickling tank 1, oblong in shape, through which a band 2 circulates, along a longitudinal running axis 10 which, normally, is located in the longitudinal median plane P of the tank 1. The latter is delineated by a bottom 11, two longitudinal walls 12, 12' parallel to the running axis 10 and, at each extremity, two transversal walls 13, 13' each provided with a threshold 14, 14'. The tank 1 is filled with a pickling liquid bath 3 whose upper surface 30 reaches, without exceeding, the level of both thresholds 14, 14'. The excess liquid overflows into recovery chutes 15, 15' located at both extremities of the tank 1, whereas the acid collected is evacuated toward a storage tank 6.

The band 2 is driven, along the running axis 10, by means not represented, for example a coil and passes in succession through the different tanks while forming, inside each of them, a curve with two extremities 21, 21' placed at an upper level and a centre portion 22 located at a lower level, beneath the surface 30 of the pickling liquid bath 3. This curve is of the 'chain' type and its deflection (f), which corresponds to the difference between the upper level determined by both thresholds 14, 14' and the lower level of the centre portion 22, depends on the mechanical characteristics of the band 2 and on the tensile strain T applied to the said band. This tensile strain can be adjusted by known means, such as tension rollers, placed at both extremities of the installation and not represented on the drawings.

In a known fashion, both extremities 21, 21' of each section of the band 2 pass between pairs of spin-drying rollers 16, 16', respectively, between the adjacent extremities of two successive tanks, i.e. over the recovery chutes 15, 15' and at the outlet of the installation. Thus, a portion of the liquid is prevented from overflowing from a tank to the next, which enables to maintain the concentration in each tank at the requested level.

Such arrangements are well known, but the invention differs essentially from the previous installations in that, instead of making the pickling operation by simple immersion into several tanks filled with acid, the said acid is sprayed directly onto the band using injection nozzles reaching inside the bath at the same level as the band and each forming a hot acid jet with sufficient impulse to enter the bath before spreading within the latter, in order to act immediately on the oxyde, in the corresponding zone of the band.

To this end, at least one of the longitudinal walls 12, 12' of each tank 1 is provided with a row of nozzles 5 at a distance from another and linked to a pressurised supply circuit 4.

These nozzles 5 are placed beneath the surface 30 of the bath 3, at different levels which depend on the longitudinal position in the bath and which are determined so that each nozzle is located substantially at the level of the band at this place of the tank. For example, as represented schematically on FIG. 3, the position of each nozzle 51 can be set by its horizontal distance x with respect to one of the end thresholds 14 and its vertical distance y with respect to the upper level of the same threshold 14.

Taking into account the mechanical characteristics of the band, in particular, its stiffness and its linear mass, i.e. its weight per length unit, it is possible to determine, in relation to the tensile strain T applied to the band, the profile of the chain-formed curve followed by the said band, inside the tank, between both thresholds 14, 14'.

As indicated, this tensile strain is applied by known tension means and determines the deflection of the chain formed by the band. The said deflection must be as small as possible in order to decrease the maximum height of the bath but, conversely, the resulting tensile strain must remain suitable for the band, taking into account the thickness of the said band and the characteristics of the metal.

The shape thus taken by the band inside each tank can then be defined under normal running conditions and, according to an essential characteristic of the invention, the sizes x and y of each nozzle 5 with respect to a back-up threshold 14 are determined in order to correspond substantially to the position of the curve followed by the band 2, at the same distance x from the threshold 14.

Thus, each nozzle 5 reaches into the bath 3 substantially at the same level as the corresponding portion 23 of the band 2 passing through the tank 1 and makes a liquid jet which enters the bath 3. This liquid jet is centred on a substantially horizontal axis and therefore acts directly on the oxyde covering the metal band, while spreading evenly below and above the said band.

If necessary, each nozzle such as 51 could be replaced with a pair of two superimposed nozzles, at a small distance from one another and whose average level is determined in relation to the profile of the curve followed by the band so that, at the level of each pair of nozzles, the corresponding portion of the band passes substantially between both nozzles.

The nozzles 5 are supplied by the circuit 4 with such a pressure that each acid jet thus formed has sufficient impulse to enter the bath 3 horizontally up to sufficient distance from the wall 12, 12' to spread over both faces of the corresponding portion 23 of the band 2 and act thus immediately and with maximum efficiency on the oxyde covering this zone.

The treatment liquid acting on the oxyde is hence at higher temperature and more efficient than in the conventional immersion pickling installations.

It should be noted that the arrangement according to the invention does not exhibit the shortcomings of the flat treatment chambers of known type, which comprise back-up means intended for maintaining the rectitude of the band and in which the band must be subjected to an important tensile strain in order to reduce the frictions. In the installation according to the invention, conversely, as in the conventional immersed band arrangements, the band is simply maintained at its extremities by the back-up thresholds 14, 14' and is subjected to a lower tensile strain, which simply needs to be sufficient to determine a deflection (f) corresponding to the height of the tank. As indicated on FIG. 1, this deflection is, preferably, quite small with respect to the length between the extremities 14, 14' in order to reduce the volume of the acid bath with respect to the length treated, but we know that the tensile strain to be applied to the band increases exponentially in reverse function of the deflection of the curve. The deflection (f) of the curve followed by the nozzles 5 is therefore determined to reduce as far as possible the height of the tank, while maintaining a reasonable tensile strain in accordance with the band strength. This tensile strain remains, at any rate, smaller than that necessary, in flat chamber installations, to reduce the frictions against the back-up studs.

In practice, a pickling installation is usually provided for a particular programme of manufacture in which the thickness and the width of the band may vary. There is consequently a variation in the linear mass of the band on which the profile of chain depends, taking the tensile strain applied into account.

But we know that the tension adjustment can be performed easily, in known devices provided with tension rollers, while adjusting a difference in the rotation speed of the roll assemblies provided respectively at the inlet and at the outlet of the installation.

We shall therefore determine an average profile of the curve applicable to all the widths and all the thicknesses foreseen in the programme of manufacture and whose maintenance calls for a tensile strain in accordance with the band strength.

In service, the tensile strain applied to the band will be controlled permanently. If the linear mass of the band varies, for instance in case of changing width and/or thickness, it will suffice to adapt the tensile strain to maintain the deflection (f) of every section so that in each tank, the band passes, permanently, substantially at the level of each nozzle.

Moreover, to reduce the volume of the bath still further, it is advantageous to provide the bottom 11 of the tank 1 with a concave shape, substantially parallel to that of the chain formed by the band 2 which, thus, runs along the bottom 11, at a small distance (e) from the said bottom. Taking into account that the lateral injection nozzles 5 of the liquid are placed substantially at the level of the band, a portion of the liquid injected spreads inside this small thickness space, comprised between the band and the bottom, and the pressurised introduction of the liquid into this confined space causes swirls favourable to the treatment.

As indicated previously, the tensile strain applied to the band will be controlled to maintain the deflection (f) so that the band remains parallel to the bottom without any risk of friction against the said bottom.

Besides, each treatment tank 1 is advantageously provided, at both its extremities, with two pairs of injection ramps 52, 52', placed respectively above and below the band 2 and each comprising a manifold provided with a series of nozzles distributed over the whole width of the band in order to project onto the said band a fluid curtain. These nozzles are oriented at an acute angle with respect to the band plane, whereas the fluid curtain is directed toward the inside of the tank, i.e. along the running direction of the band, at the upstream extremity 13 and along the reverse direction at the downstream extremity 13'.

The installation according to the invention keeps all the advantages of the simple immersion pickling installations since the band is subjected to the action of the acid over the whole length of its path in the bath 3. However, this action is more intense at each nozzle. The supply flowrate of the nozzles 5 must, besides, be determined in relation to the characteristics of the band and to the hot rolling conditions upon which depend the quantity and the quality of the oxyde to be eliminated.

It should be noted, on the other hand, that the running of the band 2 inside the bath 3 ensures an even treatment over the whole surface of the band, even if a small number of nozzles is used. For example, as represented on FIGS. 1 and 2, it will be generally sufficient, for a tank of usual sizes, to place four injection nozzles 5 on a longitudinal side of the tank and three or four nozzles on the other side, whereas the nozzles are advantageously offset with respect to one another in the longitudinal direction to distribute better their action. Moreover, each nozzle can be advantageously arranged so as to form a flat jet extending along the band plane in the corresponding zone of the band.

Since the nozzles 5 must be pressurised fed and have a significant flowrate, it is interesting to use, as a means of pressurised supply, the closed recirculation system which, usually, is associated with each tank to ensure reheating of the acid. Each tank 1 of the installation will therefore be associated with a circuit 4 comprising a pump 42 driven by a motor 43 and connected by a circuit 40 comprising a heat exchanger 44, to a manifold 46 to which are connected a plurality of supply ducts 47 linked respectively to each of the nozzles 5.

As the flowrate to be injected depends on the pickling action to be made and not only on the quantity of heat to be supplied for maintaining the temperature of the bath. It is the reason why the recycling circuit 4 associated with each tank 1 must be suited to this effect.

First of all, to ensure regularity of the recycled flow rate, the circuit 4 is supplied by one or several exhaust orifices 45 provided on at least one of the lateral walls 12, 12' of the tank 1, at the surface 30 of the bath, in order to operate according to an overflow system, whereas each orifice 45 has a wide opening, preferably rectangular and covering a certain height so that any excess of liquid can be absorbed immediately by an exhaust caisson 61 and sent back, by a manifold 62, to a storage reservoir 6. Thus, a kind of closed circuit is made in which the bath 3 is used as a buffer, whereas the whole acid flowrate injected by the nozzles 5 is sent back to the storage tank 6 from which the acid is collected by the pump 42 in order to pressurise the nozzles 5, after reheating in the heat exchanger 44.

Preferably, the liquid circulation pump 42 is of the centrifugal type. To maintain the efficiency of the treatment and to suit it to the quantity and to the quality of the oxyde to be eliminated, taking into account the circulation speed of the band, the flowrate and the pressure of the liquid injected can be influenced, simply by varying the speed of the driving motor 43 of the pump 42. Thus, if needed, the flowrate and the pressure of the liquid injected by the nozzles 5 can be raised simultaneously in order to increase the impulse of the jets coming into contact with the corresponding zone 23 of the band 2. Besides, the temperature of the acid can also be adjusted using the heat exchanger 44.

Furthermore, circulation of the liquid is generally provided between the adjacent tanks in the reverse running direction of the band. In the invention, this circulation is made advantageously at the storage tanks 6. Indeed, as shown schematically on FIG. 3, on which the band circulates from right to left, the storage tank 6 receives, through a linking duct 63, a certain quantity of acid from the storage tank associated with the tank 1*b* located downstream of the tank 1 in the running direction of the band and, conversely, is connected by a duct 64 to the tank 6*a* associated with the tank 1*a* located upstream of the tank 1 in the running direction of the band. A cascade circuit is thus formed, whereby each linking duct 63, 64 is provided with a valve 65 enabling to adjust the flowrate of liquid transferred from one tank to the next.

The first tank of the installation, upstream in the running direction of the band, contains therefore the acid the most filled with iron oxide. In a known fashion, it is associated with means of purification and regeneration, not illustrated, whereas the new acid is sent back to the last tank, lowermost, in the installation.

Obviously, the invention is not limited to the details of the embodiment that has just been illustrated and described and various other changes and modifications can be made without departing from the spirit and scope of the invention. It is therefore intended to cover in the appended claims all such changes and modifications that are within the scope of this invention.

Figure 3:
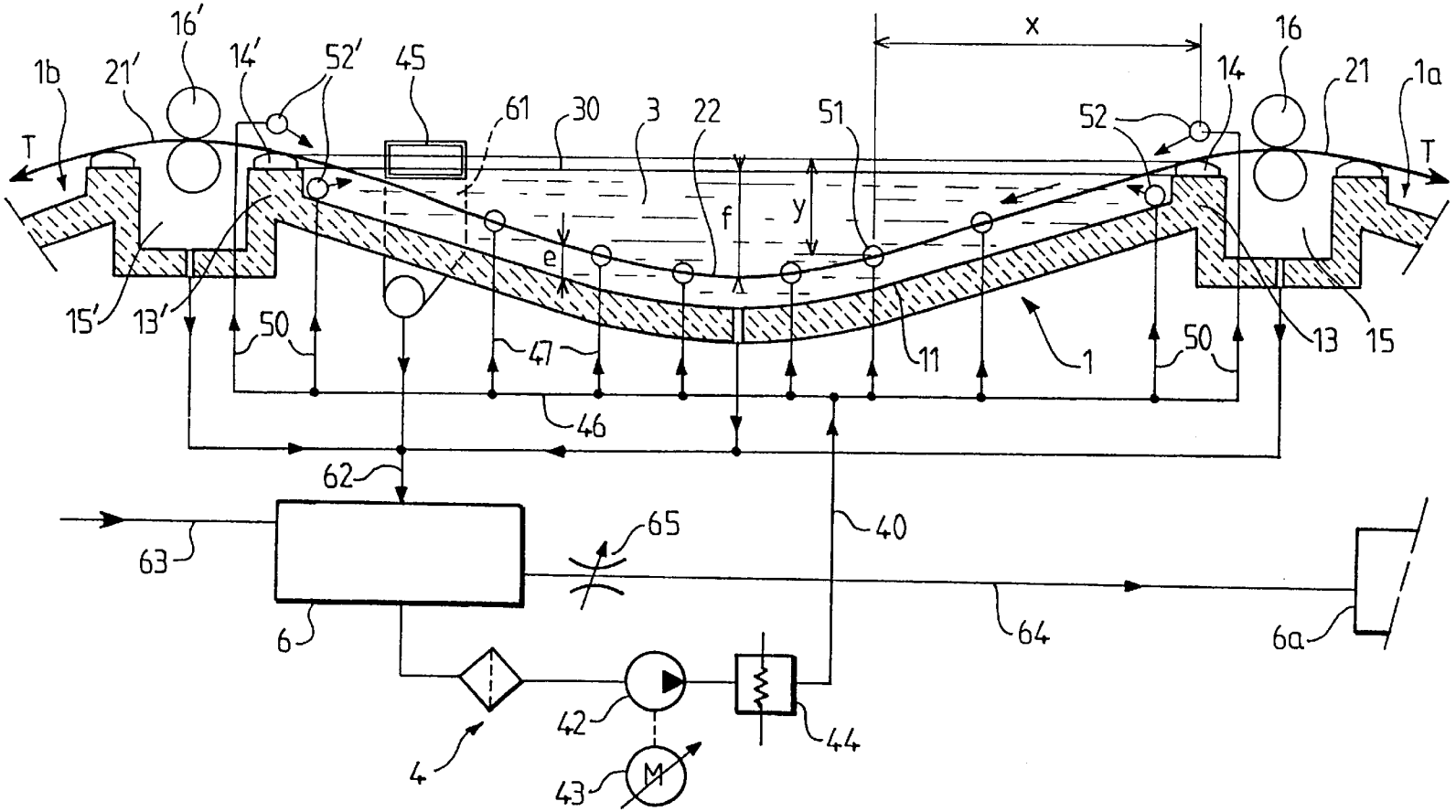
FIG. 3 shows schematically the supply circuit of a pickling liquid tank.

Thus, on the drawing of FIG. 3, the tank 1 is provided with an overflow 45 placed substantially at its upper portion. In a more sophisticated embodiment, represented on FIGS. 1 and 2, several overflow caissons such as 45*a*, 45*b* can be used, the orifices of which reach into the tank 1 at different levels, whereas each caisson is provided with a removable closing means. The result is a simple and quick means for adjusting the level of the bath 3 inside the tank 1.

In operation at normal speed, corresponding for instance to the rolling speed in a continuous production installation, the surface 30 of the bath 3 is maintained by the overflow 45*a* at the highest level, normally slightly below the back-up thresholds 14, 14'. In such a case, the second overflow 45*b* is closed.

If drawback appears on the production line and calls for shutting the said unit down for a certain period of time, the band can obviously not be left immobile inside the pickling bath. Therefore, such an installation is usually associated with a system of accumulation of a certain band length that enables to stop a production phase, for example the rolling operation, for a certain time, without stopping completely the band running through the pickling baths. Indeed, the length of the band previously accumulated may circulate further through the pickling installation whose speed will simply be lowered. The efficiency of the acid bath can be reduced by inhibitors but it is necessary, normally, to keep a minimum speed that need not be compatible with the capacity of the accumulator, taking the length of the downtime into account.

The use of several overflows brings an additional means for controlling the pickling operation at slow speed. Indeed, if the circulation speed of the band 2 should be reduced significantly, the second overflow 45*b* should be opened, through which the acid flows immediately, whereas the surface 30 drops to a lower level. If the deflection (f) of the curve is relatively small with respect to the length of the tank, this level drop of the surface 30 determines a very significant reduction of the band length remaining immersed in the bath and the risks of any excessive pickling are lessened.

Obviously, each tank 1 is provided, at its lowest point, with an orifice connected to the manifold 62 and enabling complete and rapid purge, if required.

Besides, the arrangements that have just been described can also be subject to various improvements. For example, in the embodiment represented on FIGS. 1 and 2, the bottom 11 of the tank is provided with oblong bosses 7 each of a height smaller than the distance between the bottom of the tank and band 2 so that the said band may not rub against the said bosses. These bosses are advantageously arranged into two series, on either side of the median plane P and forming with the said plane, acute and opposed angles, whereas both series are preferably offset longitudinally. These bosses, staggered, deviate the liquid jets injected beneath the band and form swirls that improve the contact of the band with the liquid injected and favour removal of the oxyde.

As already indicated, accurate control of the tensile strain applied to the band enables to maintain the shape of each section so that, in each tank 1, the band 2 runs at a small distance from the bosses 7, without any risk of friction against the said bosses.

What we claim is:

1. An installation for pickling a metal band comprising at least one oblong tank centred on a longitudinal axis and having a bottom, two longitudinal walls and two extremities each closed by a transversal wall, whereas the tank is filled with a pickling liquid bath with a surface, means for controlling the running of the band inside the tank along a direction parallel to the axis of the said tank, means for guiding and backing up the band, located respectively at both extremities of each tank and each delineating a back-up level for the band, means for tensioning the band under a tensile strain, whereas the said band provides, inside each tank, an immersed section in the form of an upward concave curve with two extremities each placed at an upper level determined by the back-up means of the band and a central portion lying lower than the surface of the bath, whereby the level difference depends on the tensile strain applied to the band, wherein each tank is provided with at least one row of injection nozzles distributed along at least one of the longitudinal walls of the tank and linked to a pressurised supply circuit filled with pickling liquid in order to form at least one series of liquid jets penetrating inside the bath and the said nozzles are offset longitudinally and placed at different levels which, for each nozzle, depend on the longitudinal distance of the said nozzle with respect to an extremity of the tank and correspond substantially to the level of a portion of the band located at the same distance from the said extremity, so that the liquid jet injected into the bath by each nozzle is directed to the portion of the band passing in front of the nozzle in question.

2. A pickling installation according to claim 1, wherein the tensile strain applied to the band by the tensioning means of the said band, is adjusted so that the central portion of the curve formed by the band is maintained at substantially constant level and for all the sizes foreseen in the programme of manufacture, the band running through the bath passes before each nozzle in succession.

3. A pickling installation according to claim 1, wherein the injection nozzles are each centred on a substantially horizontal axis and are distributed into two rows arranged respectively along both longitudinal walls of the tank.

4. A pickling installation according to claim 3, wherein both rows of nozzles are offset longitudinally with respect to one another so that the jet of a nozzle from a longitudinal wall passes between the jets emitted by two nozzles of the other wall.

5. A pickling installation according to claim 1, wherein the injection nozzles are oriented so that the jet of injected liquid is centred on a direction forming a non-right angle with the longitudinal running direction of the band and against the running direction of the said band.

6. A pickling installation according to claim 1, wherein each nozzle forms a flat jet, widening along a median plane substantially aligned with the matching part of the band passing before the nozzle in question.

7. A pickling installation according to claim 1, wherein each tank is associated with at least an injection ramp located at least at one extremity of the tank and provided with a plurality of injection nozzles directed toward the inside of the tank and distributed over the whole width of the said tank, whereas the said ramp is connected to a pressurised circuit supplying the pickling liquid.

8. A pickling installation according to claim 1, wherein the bottom of the tank has an upward concave shape, substantially parallel to that of the curve followed by the band.

9. A pickling installation according to claim 8, wherein the tensile strain applied to the band by the tensioning means is adjusted so that the curve formed by the band remains permanently substantially parallel to the bottom and spaced from the said bottom by a safety distance that is sufficient to avoid any contact between the band and the bottom while the band is running.

10. A pickling installation according to claim 9, wherein the bottom of the tank is provided with a plurality of oblong bosses protruding toward the inside with respect to the bottom of the tank, each at a height smaller than the safety distance between the band and the bottom.

11. A pickling installation according to claim 10, wherein the bosses extend respectively from two longitudinal walls up to the vicinity of a longitudinal median plane of the tank and following directions describing opposite angles with the said plane.

12. A pickling installation according to claim 1, wherein each tank is provided with at least one orifice provided in at least one of the longitudinal walls of the tank and reaching into an exhaust circuit, for maintaining, by an overflow system, the surface of the pickling bath, at a substantially constant level.

13. A pickling installation according to claim 12, wherein each tank is provided with at least two exhaust orifices located at two different levels with respect to the upper level of the back-up means and each associated with a removable closing means, for selective maintenance of the level of the surface of the bath substantially at two levels at least by opening one of the orifices and closing the other orifice, whereas the level of the orifice kept open is determined in relation to the running speed of the band in order to suit the immersion length in the tank to the said running speed.

14. A pickling installation according to claim 12, wherein each exhaust orifice leads to an exhaust caisson linked to a storage tank to which is connected a supply circuit of the injection nozzles by recycling the pickling liquid overflowing from the tank, whereas the said circuit comprises a means for reheating the recycled liquid.

15. A pickling installation according to claim 14, comprising a plurality of tanks, each associated with a storage tank and through which the band circulates in succession, wherein the storage tanks are linked to one another by ducts in order to enable the liquid to circulate from one tank to another in reverse direction of the running direction of the band, while increasing, from one tank to the next, the concentration in pickling liquid acid, whereas the tank associated with the uppermost tank in the running direction of the band is connected to purification and regeneration means of the liquid and whereas the regenerated liquid is sent back to the lowermost tank in the running direction of the band.

16. A pickling installation according to claim 1, wherein the pickling liquid supply circuit comprises at least one pump leading to a manifold to which are connected feeding ducts for each injection nozzle.

17. A pickling installation according to claim 16, wherein the supply pump is of the centrifugal type and is driven into rotation by a motor whose speed is adjusted in order to adapt the flowrate and the pressure of the liquid injected to the pickling conditions to be ensured for the band.

* * * * *